US006817607B2

(12) United States Patent
Gasch

(10) Patent No.: US 6,817,607 B2
(45) Date of Patent: Nov. 16, 2004

(54) STACKING DEVICE FOR FLAT MAIL PIECES STANDING ON THEIR EDGES

(75) Inventor: Thomas Gasch, Constance (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/368,021

(22) Filed: Feb. 19, 2003

(65) Prior Publication Data

US 2003/0137098 A1 Jul. 24, 2003

Related U.S. Application Data

(63) Continuation of application No. PCT/DE01/03243, filed on Aug. 24, 2001.

(51) Int. Cl.[7] ..... B65H 29/38
(52) U.S. Cl. ..... 271/177; 271/207; 271/213
(58) Field of Search ..... 271/177, 178, 271/179, 207, 213, 214, 215

(56) References Cited

U.S. PATENT DOCUMENTS 5,217,218 A * 6/1993 Ricciardi ..... 271/179 X
5,221,080 A * 6/1993 Ricciardi ..... 271/214
5,524,876 A * 6/1996 Porter ..... 271/178
5,575,464 A * 11/1996 Martinez et al. ..... 271/178 X
6,588,743 B2 * 7/2003 Yap ..... 271/215

* cited by examiner

*Primary Examiner*—David H. Bollinger
(74) *Attorney, Agent, or Firm*—Jacob Eisenberg; Siemens AG

(57) ABSTRACT

The invention relates to a stacking device for flat postal items standing on edge. The stacking device comprises guide means for guiding the postal items supplied to it to a stacking position on a stacking base against a support wall on which the postal items are slowed down. Of course the present invention may apply to other types of articles as well. The stacking device is further provided with a stacker plate that can be displaced in the direction of stacking along a linear guide. The stacker plate cooperates with a spring element to produce a pressure force that is approximately constant across the zone of displacement and that is directed against the forming stack. The movable part of a damper element is fastened on the movable part of the spring element, said damper element being only active when a displacement directed away from the stacking position is exerted. If the spring element is configured as a constant force spring wound up on a coil, a oration damper is fastened on the coil that is effective only in the case of an unwinding movement in such a manner that the rotating parts and the stationary parts are interlinked.

18 Claims, 3 Drawing Sheets

STACKING DEVICE FOR FLAT MAIL PIECES STANDING ON THEIR EDGES

CONTINUATION DATA

The present invention is a continuation of and claims priority to international application: PCT/DE01/03243, filed Aug. 24, 2001, and further claims priority to German patent application 10043206.9, filed Sep. 1, 2000, both of which are incorporated herein by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to an apparatus for stacking articles and in particular to a stacking apparatus for flat mail pieces which stand on their edges. A stacking base is provided, upon which mail pieces are fed. A supporting wall is also provided for braking the incoming mail pieces. The apparatus includes a guiding means for controlling the fed mail pieces. Furthermore, the apparatus includes a support pallet which is linearly displaceable in a direction of the stack. The displacement may be facilitated by a scroll spring wound up on a spool so as to impart a substantially equally displaced force on the pallet in the direction of the stack. The scull spring imparts a resistance force upon the pallet. In coming mail pieces carry with them a certain kinetic energy accumulated from their motion resulting from the stacking process. This kinetic energy is imparted on the pallet as the mail piece comes into contact with it enroute to being stacked. The scroll spring counters this imparted energy. Mail pieces with a relatively high kinetic energy (v=m/s, m>30 g) impact the pallet causing it to momentarily lose contact with the stack. Accordingly, stack supporting force from the pallet is momentarily lost and the incoming mail piece bounces off the supporting wall rather than coming to rest as a result of the friction fit between pallet and stack.

One solution to this problem was proposed in EP 0 626 927 B1, wherein at the pallet, additionally to the force produced by the scroll spring in the initial area of the motion area of the pallet close the stack-in point, an additional force is produced by a combined effort of a spline profile plate and the pallet. If there is a relatively heavy mail piece to be stacked, then the force necessary for the safe support which also lies above the spring force is produced at the pallet by contacting the ramp areas of the spline profile plate. This force can only change discontinuously and can only be produced in the first part of the stack of mail pieces. Although the stack becomes more elastic as it becomes larger, and a bouncing away from the stack is thereby often prevented, it can happen that also at already stacked-in stacks (for example with several stacked-in, thick, and hard mail pieces), a pulsed moving away of the pallet from the mail piece occurs with growth of the stack.

SUMMARY OF THE INVENTION

A task of the present inventive apparatus is to produce a generic stacking device with a pallet which is pressed against the stack by a spring element, wherein a pulsed removal of the pallet from the stack is prevented over the entire stacking area, independent from the strength of the kinetic energy of the mail pieces arriving at the stack-in point, such that the increased counterforce is always produced in proportion to the imparted kinetic energy.

The damping of the motion of the pallet over the entire motion area by the momentary reduction of the excessive energy of the heavier mail pieces is the more effective the higher the kinetic energy of the mail pieces to be stacked. The higher the kinetic energy of the arriving mail piece, the higher the braking moment of the damping element, caused by the higher speed, with which the pallet wants to remove itself from the stack of mail pieces.

It is advantageous to attach to the spool of the scroll spring, at a formation of the spring element as scroll spring, a rotary damper which is only effective during the unwinding motion, in such a way, that the rotating parts and the stationary parts are connected together. It is thereby advantageous to provide the rotary damper with a free-wheel.

To compensate the tolerances, it is advantageous to connect the rotary damper with the spool by a compensating coupling for deviations of position.

These and other advantages are also achieved from an apparatus for stacking articles in a stack, comprising: a base having a top surface for supporting a bottom of said stack; a supporting wall abutting said base, said supporting wall providing support for a first side of said stack, and said supporting wall comprising a guide rail running substantially parallel to said base; a pallet for supporting a second side of said stack, said pallet affixed to said guide rail; and article insertion means for inserting successive article into said stack, said articles being conveyed by said insertion means in a direction of said supporting wall and pallet such that kinetic energy from said conveyed article is imparted on said pallet; and dampening means affixed to said pallet, said dampening means providing to said pallet a counterforce in proportion to said kinetic energy.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

Figure 1:
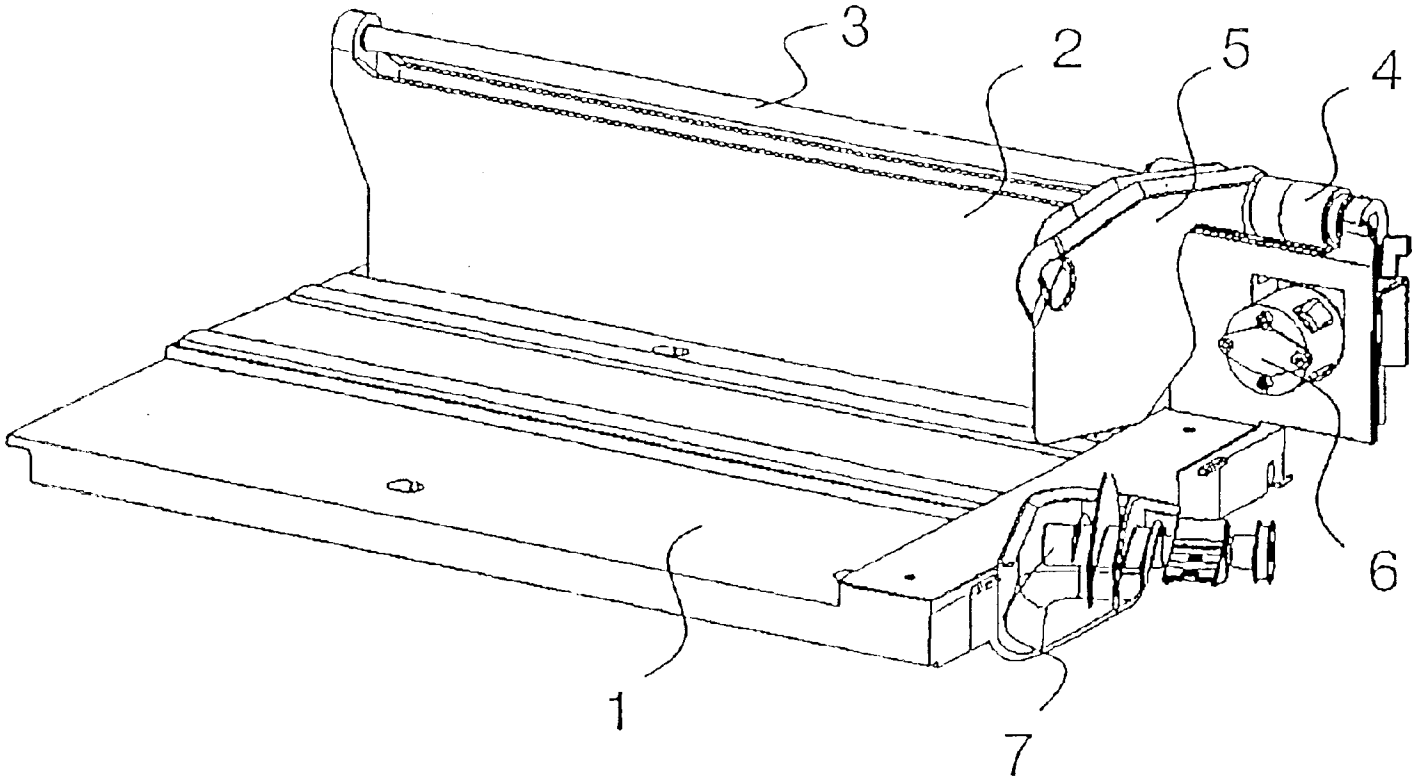
FIG. 1 a perspective view on the stacking device with the stacking base without mail pieces, FIG. 2 a perspective view on a cut-out of FIG. 1 with the rotary damper and the scroll spring and removed supporting wall, FIG. 3 a perspective view on the stacking device with a stacked-in mail piece FIG. 4 a perspective view on the stacking device with two stacked-in mail pieces.

The present invention is related to the stacking of articles and will be discussed by way of example with application to stacking postal or mail items. As is depicted in FIG. 1, base 1 includes two slide rails upon which mail pieces slide relatively friction free in conjunction with a growing stack. A supporting wall 2 with a round guide rail 3 is attached to the base at the linear guides. A ball socket 4 runs along guide rail 3 facilitating lateral displacement of a swiveling pallet 5.

Mail pieces are introduced from the right hand side of the figure, over the right aisle of the stacking spindle 7 and diagonally towards the pallet 5. In particular, successive mail pieces stack against pallet 5. This causes pallet 5 to laterally displace from a stack-in position or position abutting and supporting the stack. The rotating stacking spindle 5 is responsible that the back part of the mail pieces is moved fast to the left. It is thereby assured that the next mail piece, following at a short distance, doesn't meet with the back edge of the preceding mail piece. Finally, a rotary damper 6 is provided in functional association with the pallet 5. The purpose and function of the damper is set out below with respect to FIG. 2.

Figure 2:
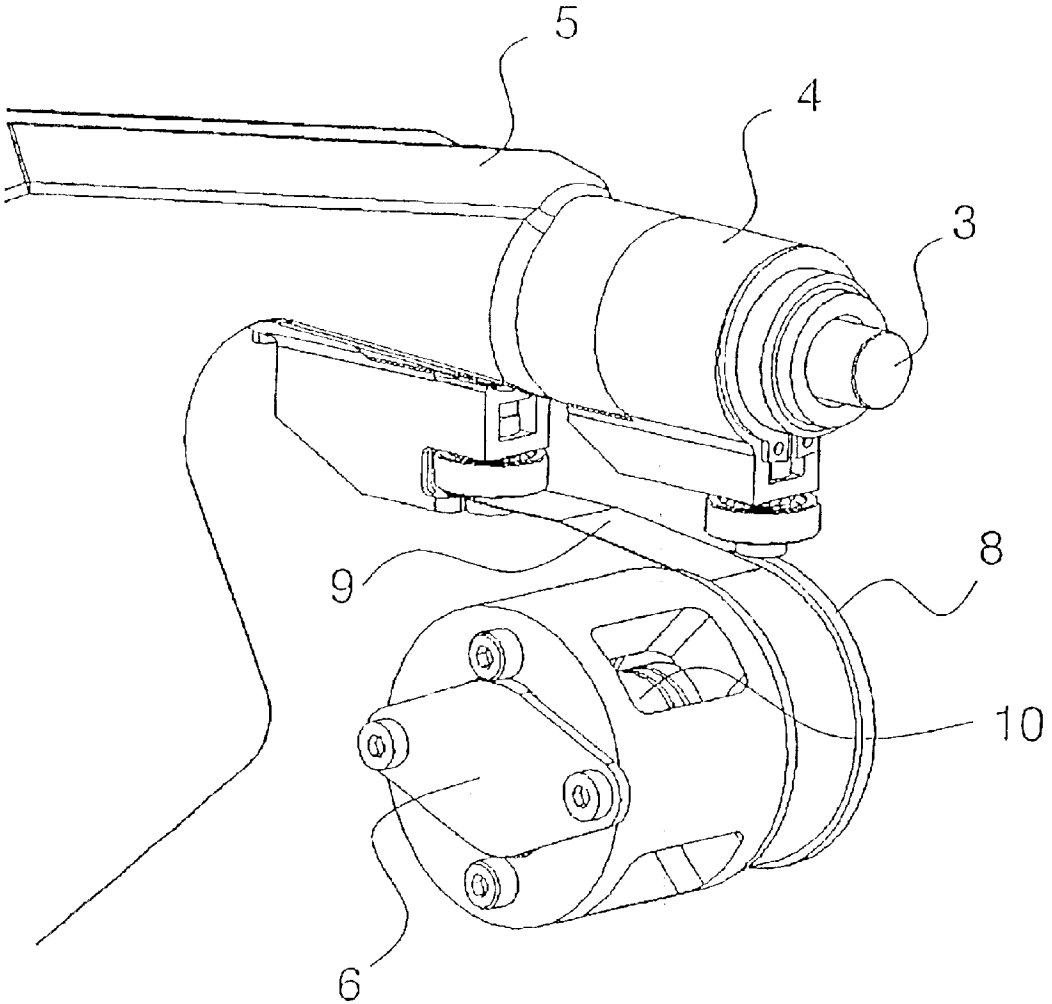

FIG. 2 depicts damper 6. The damper includes a tail piece of a band-shaped scroll spring, which is wound up on a pivoted spool 8 and attached to moveable ball lining 4. The other end of the scroll spring 9 is physically attached to or wound on and frictionally held to spool 8. Because of the flat spring characteristic of the scroll spring 9 over the entire displacement area, the pallet 5 is pressed with an almost constant force against the constructing stack of mail pieces. The spool 8 is connected to a rotary damper 6, which is active in only one direction of rotation, by a coupling 10, which is responsible for the compensation of displacements and inaccuracies, whereby the moving parts are connected and the stationary parts are connected together. The rotary damper 6 includes a free-wheel and is only active during the unwinding of the scroll spring 9, so that the winding up of the scroll spring 9 takes place damping-free and therefore fast. For example, during the stacking of mail pieces 11, 12, each having an example mass greater than approximately 30 g and a stacking speed of approximately 4 m/s, a certain kinetic energy is imparted upon the pallet 5 and rotary damper 6 by the impact of the mail pieces against the pallet and supporting wall 2. Because the energy is momentarily reduced by the rotary damper 6, the pallet 5 never loses contact with the stack of letters. Mail pieces 11, 12 with a mass, for example, of less than approximately 30 g, only have a low kinetic energy at a stack-in speed of 4 m/s, so that the pallet 5 is not pulsed or jolted away from the stack of letters and against the spring force.

Figure 3:
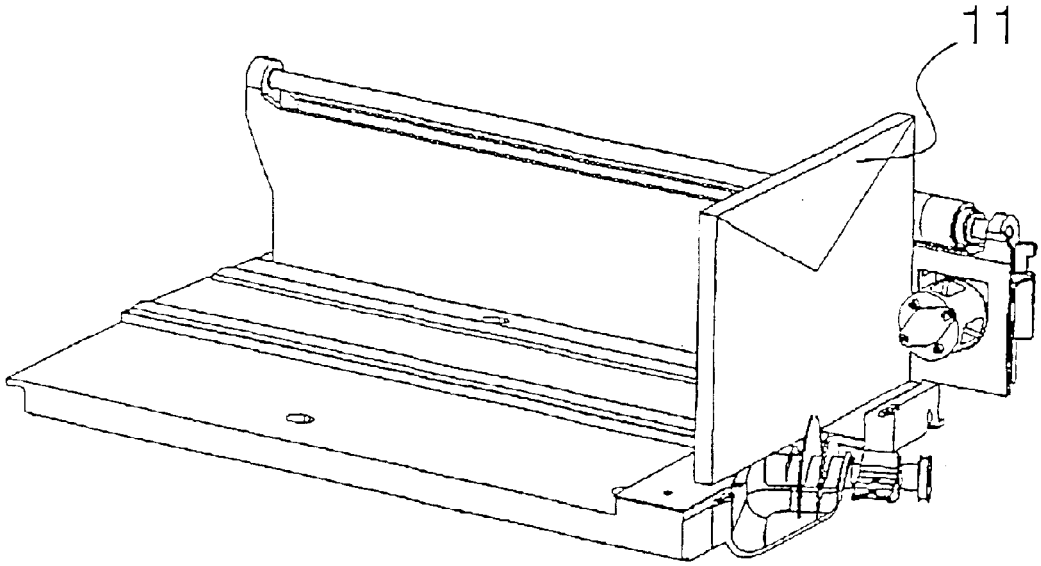
Figure 4:
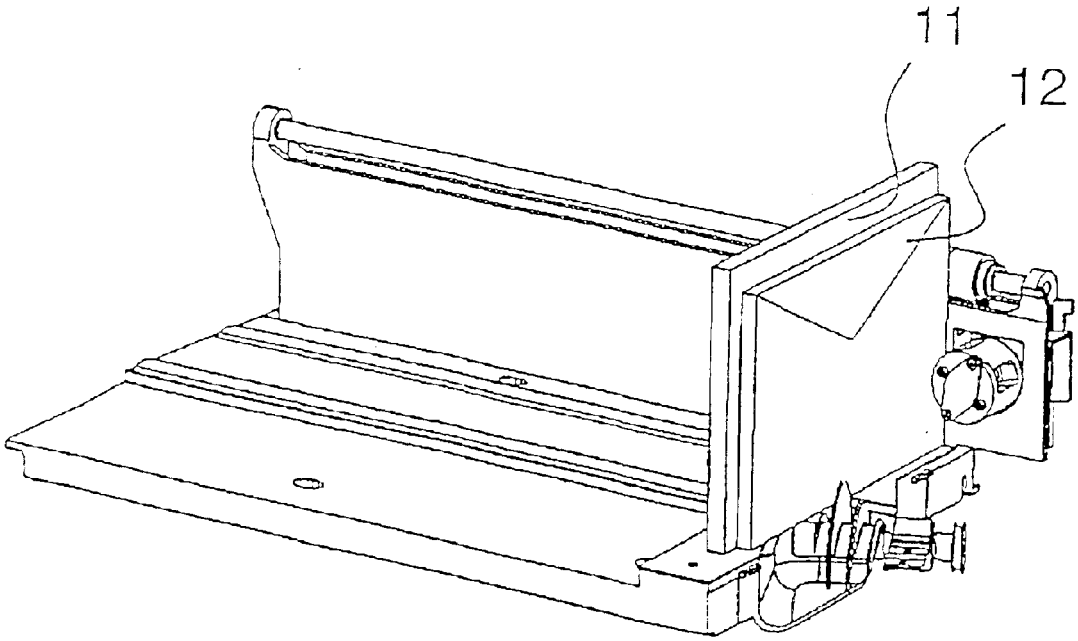

The stacking device with the constructing stack of mail pieces, starting with first mail piece 11 and the second mail piece 12 is disclosed in the FIGS. 3 and 4.

The invention being thus described, it will be obvious that the same may be varied in many ways. The variations are not to be regarded as a departure from the spirit and scope of the invention, and all such modifications as would be obvious to one skilled in the art are intended to be included within the scope of the following claims.

I claim:

1. An apparatus for stacking articles in a stack, comprising:

a base having a top surface for supporting a bottom of said stack;

a supporting wall abutting said base, said supporting wall providing support for a first side of said stack, and said supporting wall comprising a guide rail running substantially parallel to said base;

a pallet for supporting a second side of said stack, said pallet affixed to said guide rail;

article insertion means for inserting successive articles into said stack, said articles being conveyed by said insertion means in a direction of said supporting wall and pallet to a stack in point such that kinetic energy from said conveyed article is imparted on said pallet;

dampening means operable in a direction away from said stack in point; and spring means for production of a stacking pressure force, said spring means being attached to said pallet and said dampening means.

2. The apparatus according to claim 1, wherein said spring means comprises a scroll spring, and wherein said dampening means further comprises a spool upon which said spring means is functionally attached.

3. The apparatus according to claim 1, wherein said dampening means comprises a free wheel.

4. The apparatus according to claim 1, wherein said dampening means further comprises a coupling which compensates for deviations of position.

5. The apparatus according to claim 1, wherein said articles comprises mail pieces.

6. The apparatus according to claim 1, wherein said pallet is substantially frictionlessly affixed to said guide rail.

7. The apparatus according to claim 1, wherein said damping means provides a counterforce which is substantially uniform about said pallet.

8. An apparatus for stacking articles in a stack, comprising:

a base having a top surface for supporting a bottom of said stack;

a supporting wall abutting said base, said supporting wall providing support for a first side of said stack, and said supporting wall comprising a guide rail running substantially parallel to said base;

a pallet for supporting a second side at said stack, said pallet affixed to said guide rail; and article insertion means for inserting successive articles into said stack, said articles being conveyed by said insertion means in a direction of said supporting wall and pallet to a stack in point such that kinetic energy from said conveyed article is imparted on said pallet;

dampening means operable in a direction away from said stack in point, said dampening means comprising a free wheel; and spring means for production of a stacking pressure force, said spring means being attached to said pallet and said dampening means.

9. The apparatus according to claim 8, wherein said spring means comprises a scroll spring, and wherein said dampening means further comprises a spool upon which said spring is functionally attached.

10. The apparatus according to claim 9, wherein said damping means provides a counterforce which is substantially uniform about said pallet.

11. The apparatus according to claim 8, wherein said dampening means further comprises a coupling which compensates for deviations of position.

12. The apparatus according to claim 8, wherein said articles comprises mail pieces.

13. The apparatus according to claim 8, wherein said pallet is substantially frictionlessly affixed to said guide rail.

14. An apparatus for stacking articles in a stack, comprising:

a base having a top surface for supporting a bottom of said stack;

a supporting wall abutting said base, said supporting wall providing support for a first side of said stack, and said supporting wall comprising a guide rail running substantially parallel to said base;

a pallet for supporting a second side of said stack, said pallet affixed to said guide rail; and article insertion means for inserting successive articles into said stack, said articles being conveyed by said insertion means in a direction of said supporting wall and pallet to a stack in point such that kinetic energy from said conveyed article is imparted on said pallet;

dampening means operable in a direction away from said stuck in point, said dampening means comprising a coupling which compensates for deviations of position; and and spring means or production of a stacking pressure force, said spring means being in functional association with said pallet and said dampening means.

15. The apparatus according to claim 14, wherein as spring means comprises a scroll spring, and wherein said dampening means further comprises a spool upon which said spring is functionally attached.

16. The apparatus according to claim 14, wherein said dampening means comprises a free wheel.

17. The apparatus according to claim 14, wherein said articles are mail pieces.

18. The apparatus according to claim 14, wherein said pallet is substantially frictionlessly affixed to said guide rail.

* * * * *

UNITED STATES PATENT AND TRADEMARK OFFICE

CERTIFICATE OF CORRECTION

PATENT NO. : 6,817,607 B2
APPLICATION NO. : 10/368021
DATED : November 16, 2004
INVENTOR(S) : Gasch It is certified that error appears in the above-identified patent and that said Letters Patent is hereby corrected as shown below:

On the title page: Item [30] insert, Foreign Application Priority Data
--Sept. 1, 2000 [DE] Germany……100 43 206.9--

Signed and Sealed this

Thirteenth Day of May, 2008

JON W. DUDAS
*Director of the United States Patent and Trademark Office*